US007880703B2

(12) United States Patent
Park et al.

(10) Patent No.: US 7,880,703 B2
(45) Date of Patent: Feb. 1, 2011

(54) LIQUID CRYSTAL DISPLAY AND DRIVING METHOD THEREOF

(75) Inventors: Joon Kyu Park, Goyang-si (KR); Hyun Suk Jin, Anyang-si (KR); Sook Kyung You, Seoul (KR); Hyun Seok Jang, Seongnam-si (KR)

(73) Assignee: LG Display Co., Ltd., Seoul (KR)

( * ) Notice: Subject to any disclaimer, the term of this patent is extended or adjusted under 35 U.S.C. 154(b) by 946 days.

(21) Appl. No.: 11/797,083

(22) Filed: Apr. 30, 2007

(65) Prior Publication Data

US 2007/0252801 A1 Nov. 1, 2007

(30) Foreign Application Priority Data

May 1, 2006 (KR) ..... 10-2006-0039331

(51) Int. Cl.
*G09G 3/36* (2006.01)

(52) U.S. Cl. ..... 345/87; 345/88; 345/89; 345/96

(58) Field of Classification Search ..... 345/72, 345/84, 87–89, 96, 204, 597, 690, 691; 349/65, 349/106, 110–114, 129, 145, 78, 179, 180
See application file for complete search history.

(56) References Cited

U.S. PATENT DOCUMENTS 5,808,705 A * 9/1998 Hishida et al. ..... 349/33
5,870,164 A * 2/1999 Lu et al. ..... 349/180
6,707,516 B1 * 3/2004 Johnson et al. ..... 349/78
7,113,159 B2 * 9/2006 Sawabe ..... 345/89
7,205,970 B2 * 4/2007 Kim et al. ..... 345/89
7,385,660 B2 * 6/2008 Kume et al. ..... 349/114
7,599,040 B2 * 10/2009 Asao ..... 349/179
2003/0058211 A1 * 3/2003 Kim et al. ..... 345/89
2006/0132677 A1 * 6/2006 Asao ..... 349/106
2007/0040780 A1 * 2/2007 Gass et al. ..... 345/87

* cited by examiner

*Primary Examiner*—Prabodh M Dharia
(74) *Attorney, Agent, or Firm*—Mckenna Long & Aldridge LLP

(57) ABSTRACT

A liquid crystal display for automatically adjusting brightness of interference image displayed at ECB sub pixels of quad type cells of a liquid crystal display panel in accordance with brightness of a background screen is disclosed. The liquid crystal display includes first to n-th look-up tables each holding a mapping of one first to n-th mappings of ECB brightness data to cell location information for the quad cells of the liquid crystal display panel; an image processor that calculates a brightness data distribution of an image; and a viewing angle controller that selects one of the first to the n-th look-up tables depending on the calculated brightness data distribution.

22 Claims, 6 Drawing Sheets

LIQUID CRYSTAL DISPLAY AND DRIVING METHOD THEREOF

This application claims the benefit of the Korean Patent Application No. P2006-039331, filed on May 1, 2006, which is hereby incorporated by reference for all purposes as if fully set forth herein.

BACKGROUND OF THE INVENTION

1. Field of the Invention

The present invention relates to a liquid crystal display, and more particularly to a liquid crystal display and a driving method thereof for automatically adjusting brightness of interference image displayed at ECB (Electrical Controlled Birefringence) sub pixels of cells formed in a quad type at a liquid crystal display panel in accordance with brightness of a background screen.

2. Discussion of the Related Art

A typical liquid crystal display employs a liquid crystal layer disposed between two substrates. In operation, an electric field is applied across the liquid crystal layer using opposing electrodes to controls the light transmittance of the liquid crystal layer to display a picture.

The above described liquid crystal display controls the light transmittance of individual liquid crystal cells in accordance with a video signal to display a picture. By using a liquid crystal display of an active matrix type employing active devices as switches, it is possible to realize a display capable of displaying moving pictures. In a typical liquid crystal display of the active matrix type, a switching device is provided for each crystal display cell. A thin film transistor (hereinafter, referred to as "TFT") is commonly used as the switching device in liquid crystal display of the active matrix type as shown in FIG. 1.

Referring to FIG. 1, the liquid crystal display of the active matrix type converts a digital input data into an analog data voltage on the basis of a gamma reference voltage and supplies the analog data voltage to a data line DL. Concurrently, a gate pulse is supplied via a gate line GL to turn on the TFT to thereby charge a liquid crystal cell Clc with the data voltage on the data line DL.

A gate electrode of the TFT is connected to the gate line GL and a source electrode is connected to the data line DL. A drain electrode of the TFT is connected to a pixel electrode of the liquid crystal cell Clc and to an electrode of a storage capacitor Cst. A common electrode of the liquid crystal cell Clc is supplied with common voltage Vcom.

When the TFT is turned-on, the storage capacitor Cst charges a data voltage applied from the data line DL. The storage capacitor maintains a voltage of the liquid crystal cell Clc until a new voltage is charged to the liquid crystal cell Clc.

When the gate pulse is applied to the gate line GL, the TFT is turned-on to form a channel between the source electrode and the drain electrode, thereby supplying a voltage on the data line DL to the pixel electrode of the liquid crystal cell Clc. An electric field is generated between the pixel electrode and the common electrode. The electric field controls the arrangement of liquid crystal molecules of the liquid crystal cell Clc between the pixel electrode and the common electrode to modulate the transmission of light through the liquid crystal cell.

Liquid crystal displays having the above-described structure may be roughly classified into vertical electric field applying types and horizontal electric field applying types depending upon a direction of electric field used to drive the liquid crystal.

A liquid crystal display of vertical electric field applying type drives a liquid crystal using a vertical electric field (i.e. a field directed substantially perpendicular to the liquid crystal display panel surface) formed between a pixel electrode and a common electrode arranged in opposition to each other on upper and lower substrates. In a typical arrangement, the common electrode is on an upper substrate and the pixel electrode is on a lower substrate are each made of a transparent electrode so that the liquid crystal display panel has a large aperture ratio. However, a refractive index of the liquid crystal molecules is relatively large at a major axis direction thereof and a minor axis direction thereof compared to the index of refraction along other directions. Accordingly, when the liquid crystal is driven using a vertical electric field, there is a difference between a refractive index along a front view of the display at a front side and a refractive index as viewed along a side surface of the display. As a result, a viewing angle for the display is less than 90°.

In a liquid crystal display of horizontal electric field applying type, the liquid crystal is driven in an in-plane switching (hereinafter, referred to as "IPS") mode using a horizontal electric field (i.e. a field directed substantially parallel to the liquid crystal display panel surface) between the pixel electrode and the common electrode arranged parallel to each other on the same lower substrate. In an IPS mode device, because the liquid crystal is driven by a horizontal electric field, there is substantially no difference between a refractive index as viewed from a position in front of the display and as viewed from a position towards the side of the display. As a result, the effective viewing angle is about 90°.

Typically, the liquid crystal cells of the liquid crystal display panel include RGB sub pixels of the stripe type. More recently, a liquid crystal display employing a liquid crystal display panel having cells of quad type has been developed to provide a liquid crystal display that may be selectively adjusted to have either a wide viewing angle or a narrow viewing angle. The cells of quad type are liquid crystal display panel may include one ECB (Electrical Controlled Birefringence) sub pixel and three RGB sub pixels.

FIG. 2 is a diagram showing a cell structure of quad type.

Referring to FIG. 2, a cell of quad type may include a R sub pixel, a G sub pixel, a B sub pixel, and an ECB sub pixel. The R and G sub pixels are arranged in parallel in an upper part of the cell, while the ECB and B sub pixels are arranged in parallel in the lower part of the cell.

The R and ECB sub pixels and the G and B sub pixels of a cell are not all connected to the same data line DL. In the illustrated example, the R sub pixel is located above the ECB sub pixel and the G and B sub pixels are arranged parallel to the R and ECB sub pixels, one above each other. As illustrated in FIG, 2, the R and ECB sub pixels are commonly connected to one data line DL, while the G and B sub pixels are commonly connected to another data line DL.

The R and G sub pixels and the ECB and B sub pixels of a liquid crystal cell are not all connected to the same gate line GL. In the illustrated case, the R sub pixel is horizontally adjacent to the G sub pixel and the G and B sub pixels are arranged parallel to the R and ECB sub pixels one above the other. Herein, the R and G sub pixels are commonly connected to one gate line GL and the ECB and B sub pixels are commonly connected to another gate line GL.

With the cell of a quad type connected to the data lines DL and the gate lines GL as described above, the number of data lines is decreased and the number of gate lines is increased when compared to the number of data lines and gate lines of a related art liquid display panel having a stripe type structure.

When the liquid crystal display panel is operated in a narrow viewing angle mode, the ECB sub pixels generate an image to interfere with the viewing of an image displayed by the RGB sub pixels from a position towards the side of the display.

A relationship between the display image generated by the RGB sub pixels and the interference image generated by the ECB sub pixels will be described with reference to FIG. 3.

Referring to 3, image (A) in FIG. 3 represents the display image to be displayed at the liquid crystal display panel. The image (A) is generated using the RGB sub pixels. Image (B) in FIG. 3 represents the interference image displayed using the ECB sub pixels.

The interference image (B) is displayed using the ECB sub pixels concurrently with the display of image (A) using the RGB sub pixels. When the display image and the interference image are simultaneously displayed, the display image of the mark (A) is visible and the interference image of the mark (B) is not visible when viewed from a viewing position towards the front of the liquid crystal display panel. On the other hand, when viewed from an angle along the side surface of the quad liquid crystal display panel, the display image is overlapped with the interference image in the view of an observer as indicated in image 'C' of FIG. 3.

A dark color image, for example, a character or other pattern, might be output on a bright colored background screen to be displayed the display image at the front side of the liquid crystal display panel. As a result, when the observer views the pixels from a position in front of the display, the interference image is not perceived. In other words, a display image of low brightness should be output on a background screen of high brightness to avoid perception of the displayed interference image while viewing the display image from a position in front of the liquid crystal display panel.

If a bright color display image is displayed on a dark color background screen, the display image is discerned to overlap with the interference image even when the observer views the pixels from an angle towards the front side of the liquid crystal display panel. In other words, if the display image of high brightness is output on the background screen of low brightness, the display image is perceived to overlap with the interference image even by an observer positioned directly in front of the liquid crystal display panel.

SUMMARY OF THE INVENTION

Accordingly, the present invention is directed to a liquid crystal display device and driving method thereof that substantially obviates one or more of the problems due to limitations and disadvantages of the related art.

An advantage of the present invention is to provide a liquid crystal display and a driving method thereof that are adaptive for automatically adjusting brightness of interference image displayed at ECB sub pixels of cells formed in a quad type at a liquid crystal display panel in accordance with brightness of a background screen.

Another advantage of the present invention is to provide a liquid crystal display and a driving method thereof that are adaptive for automatically adjusting brightness of interference image displayed at ECB sub pixels in accordance with brightness of a background screen to reduce or eliminate the perception of an interference image overlapping with a display image generated at the RGB sub pixels when the observer views the pixels from a position in front of a liquid crystal display panel.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display according to the present invention includes: a liquid crystal display panel having quad cells each including a R sub pixel, a G sub pixel, a B sub pixel, and an ECB sub pixel; a storage means that stores first to n-th look-up tables each holding a mapping of one of first to n-th mappings of ECB brightness data to cell location information for the quad cells of the liquid crystal display panel; an image processor that calculates a brightness data distribution of an image to be displayed using the liquid crystal display panel using input RGB data for one frame period; a viewing angle controller that selects one of the first to the n-th look-up tables, the selected look-up table depending on the calculated brightness data distribution; and a data aligner that combines ECB brightness data received from a look-up table selected by the viewing angle controller with the input RGB data, and then aligns the combined RGB data and ECB brightness data for display in accordance with a quad cell structure.

In another aspect of the present invention, a liquid crystal display is provided, the liquid crystal display including: a liquid crystal display panel having quad cells each including a R sub pixel, a G sub pixel, a B sub pixel, and an ECB sub pixel; a timing controller that calculates a brightness data distribution of an image using input RGB data, and that selects any one of first to n-the ECB data, the selected ECB data chosen with reference to the calculated brightness data distribution, and that aligns and outputs the selected ECB data brightness and the input RGB data in accordance with a cell structure of a quad cell; a data driver that converts digital RGB data and ECB data output from the timing controller into an analog data to supply the analog data to the liquid crystal display panel in response to a control signal from the timing controller; and a gate driver that selects and drives a quad cell using RGB data and ECB data output from the data driver in response to a control signal from the timing controller.

In still another aspect of the present invention, a method of driving a liquid crystal display, including a liquid crystal display panel having quad cells each including a R sub pixel, a G sub pixel, a B sub pixel, and an ECB sub pixel is provided, the method including: calculating a brightness data distribution of an image to be displayed at the liquid crystal display panel using input RGB data for one frame; selecting any one of first to n-th ECB brightness data that are preset to correspond to a predetermined first to n-th look-up tables in accordance with the calculated brightness data distribution; and mixing the selected ECB brightness data and the input RGB data to align and output the mixed RGB data and the ECB data in accordance with the cell structure of a quad cell.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, an example of which is illustrated in the accompanying drawings. Wherever possible, the same reference numbers will be used throughout the drawings to refer to the same or like parts.

Figure 1:
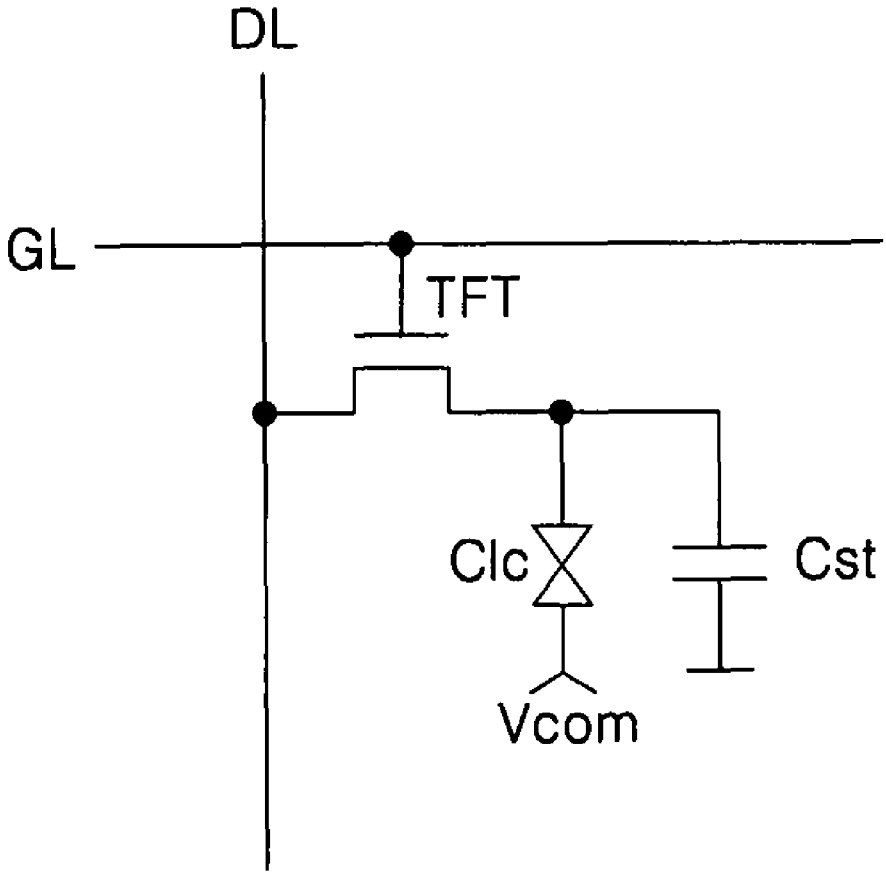
FIG. 1 RELATED ART
FIG. 1 is an equivalent circuit diagram of a cell provided at a liquid crystal display panel of a related art liquid crystal display.
Figure 2:
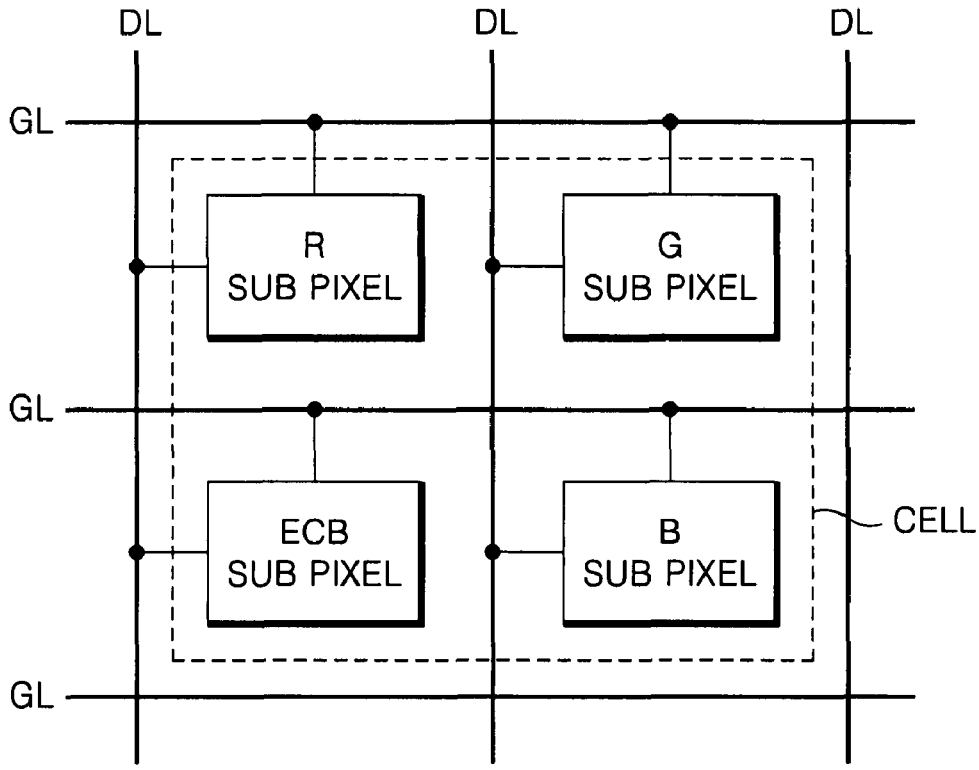
FIG.2 RELATED ART
FIG. 2 is a diagram showing a cell structure of quad type provided at the liquid crystal display panel of the related art liquid crystal display.
Figure 3:
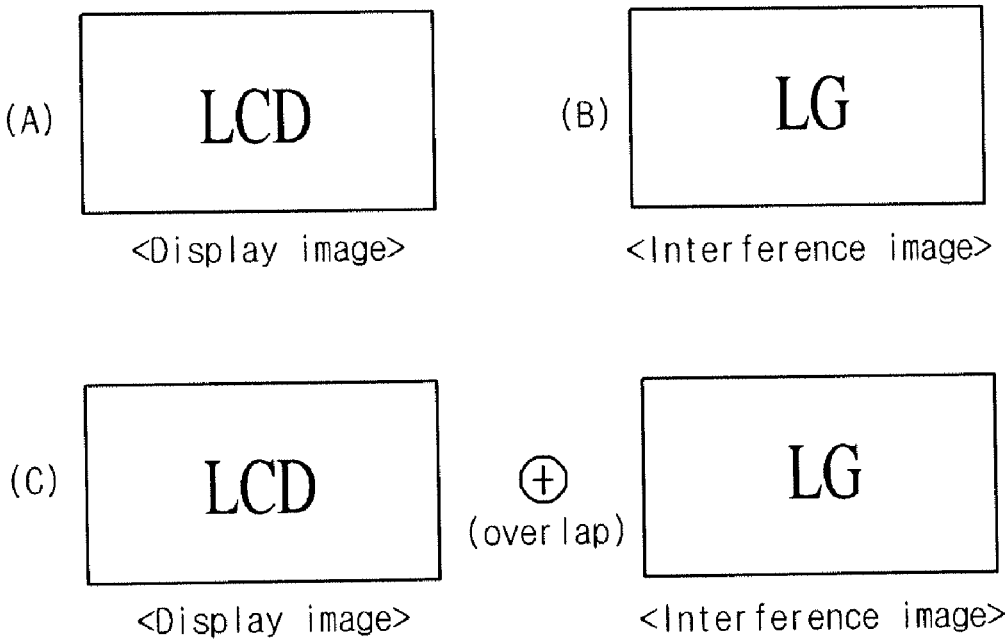
FIG.3 RELATED ART
FIG. 3 is an example diagram showing an output state of a display image and an interference image displayed in a liquid crystal display panel having a cell of quad type.
Figure 4:
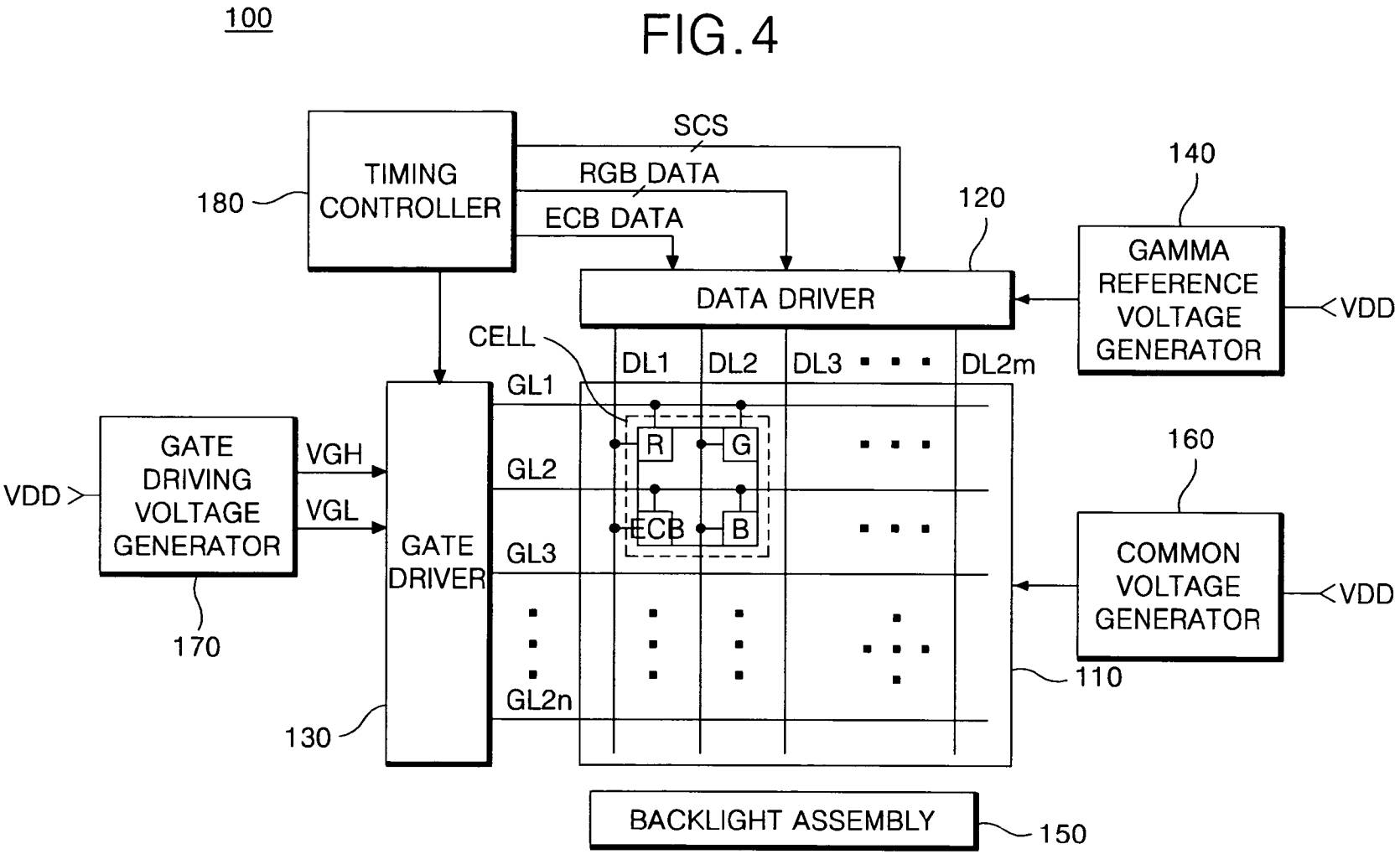
FIG. 4 is a diagram showing a configuration of a liquid crystal display according to an embodiment of the present invention.

FIG. 4 is a diagram showing a configuration of a liquid crystal display according to an embodiment of the present invention.

Referring to FIG. 4, a liquid crystal display 100 according to an embodiment of the present invention includes a liquid crystal display panel 110, a data driver 120, a gate driver 130, a gamma reference voltage generator 140, a backlight assembly 150, a common voltage generator 160, a gate driving voltage generator 170, and a timing controller 180.

The liquid crystal display panel includes data lines DL1 to DL2*m* and the gate lines GL1 and GL2*n*. The data lines DL1 to DL2*m* are separated by a constant distance and arranged to cross the gate lines GL1 and GL2*n* also separated by a constant distance. The data lines are DL1 to DL2*m* substantially perpendicular to the gate lines GL1 and GL2*n*. The RGB sub pixels and ECB sub pixels are provided at crossings of the data lines DL1 to DL2*m* and the gate lines GL1 and GL2*n* as shown in FIG. 4. A TFT is formed at each sub pixel, with each TFT supplying data provided on the data lines DL1 to DL2*m* to a respective liquid crystal cell Clc in response to a scanning pulse. A gate electrode of each TFT is connected to one of the gate lines GL1 and GL2*n*, and a source electrode of each TFT is connected to one of the data lines DL1 to DL2*m*. A drain electrode of each TFT is connected to a pixel electrode and a storage capacitor Cst of the respective liquid crystal cell Clc.

Each TFT is turned-on by a scanning pulse applied to a gate terminal of the TFT supplied via the gate lines GL1 to GL2*n* to switch analog RGB data and ECB data supplied via the data lines DL1 to DL2*m* into a pixel electrode of the respective liquid crystal cell Clc. More specifically, since the liquid crystal display panel 110 having cells of the quad type is used in the liquid crystal display 100, the cells of the liquid crystal display panel 110 including a R sub pixel, a G sub pixel, a B sub pixel, and an ECB sub pixel.

An image (e.g. a character or a pattern) is displayed with the liquid crystal display device 100 using the RGB sub pixels to which the RGB data are supplied. On the other hand, the ECB sub pixels to which the ECB data are supplied are used to selectively provide a wide viewing angle mode and a narrow viewing angle mode, by selectively displaying an interference image to interfere with the viewing of a display image generated by the RGB sub pixels when viewed from a position towards the side of the liquid crystal display panel.

The data driver 120 applies data to the data lines DL1 to DL2*m* in response to a data driving control signal SCS supplied from the timing controller 180 and samples and latches digital RGB data supplied from the timing controller 180 in both the wide viewing angle mode and the narrow viewing angle mode. The data driver 120 converts the latched digital RGB data into analog data voltages suitable for realizing a gray scale level at the liquid crystal cells Clc of the liquid crystal display panel 110 on the basis of a gamma reference voltage supplied from the gamma reference voltage generator 140 and supplies the analog data voltages to the data lines DL1 to DL2*m*.

Furthermore, the data driver 120 samples and latches the ECB data supplied from the timing controller 180 in response to the data driving control signal SCS when the narrow viewing angle mode is selected. The data driver 120 converts the latched ECB data into analog ECB data voltages that is suitable for realizing a gray scale level at the crystal cells Clc of the liquid crystal display panel 110 on the basis of the gamma reference voltage supplied from the gamma reference voltage generator 140 and supplies the analog ECB data voltages to some of the data lines. More specifically, the data driver 120 may supply the analog ECB data voltage to the odd data lines DL1, DL3, . . . , DL(2*m*−1). Further, since the ECB sub pixels are OFF in the wide viewing angle mode, the data driver 120 does not supply the ECB data to the odd data lines DL1, DL3, . . . , DL(2*m*−1) when the liquid crystal display device 100 is operated in the wide viewing angle mode. Additionally, in a liquid crystal display device according to the present invention, the brightness of an interference image displayed by the ECB sub pixels may be adjusted in accordance with brightness of the background screen.

The gate driver 130 sequentially generates a scanning pulse response to a gate driving control signal GCS supplied from the timing controller to supply it to the gate lines GL1 to GL2*n*. The gate driver 130 supplies a scanning pulse using the gate high voltage VGH and gate low voltage VGL voltage levels supplied from the gate driving voltage generator 170.

The gamma reference voltage generator 140 is supplied with a high potential power voltage VDD to generate a positive polarity gamma reference voltage and a negative polarity gamma reference voltage and to output the positive and negative gamma reference voltages to the data driver 120.

The backlight assembly 150 may be installed at a rear side of the liquid crystal display panel 110 and is supplied with an AC voltage and current from an inverter to irradiate a light onto the pixels of the liquid crystal display panel 110.

The common voltage generator 160 is supplied with the high potential power voltage VDD to generate the common voltage Vcom and supplies the common voltage Vcom to a common electrode of the liquid crystal cells Clc included in each pixel of the liquid crystal display panel 110.

The gate driving voltage generator 170 is supplied with the high potential power voltage VDD to generate the gate high voltage VGH and the gate low voltage VGL, thereby supplying them to the gate driver 130. The gate driving voltage generator 170 generates a gate high voltage VGH that is greater in magnitude than a threshold voltage of the TFT included in each pixel of the liquid crystal display panel 110 and generates a gate low voltage VGL that is lower in magnitude than the threshold voltage of the TFT. The gate high voltage VGH and a gate low voltage VGL are used to determine the high level voltage and a low level voltage for the scanning pulse generated by the gate driver 130.

The timing controller 180 is automatically initialized when the timing controller 180 is powered-on and is driven by the supplied data enable signal DE to determine a horizontal synchronization and a vertical synchronization of the RGB data and/or the ECB data supplied to the liquid crystal display panel 110 in accordance with a supplied vertical synchronizing signal Vsync and horizontal synchronizing signal Hsync. Further, the timing controller 180 generates a data driving control signal SCS controlling the supply of the RGB data and/or the ECB data to supply the data to the data driver 120 and generates a gate driving control signal GCS for controlling the supply of the scanning pulse to the gate driver 130. The data driving control signal SCS includes a source shift clock SSC, a source start pulse SSP, a polarity control signal POL, and a source output enable signal SOE. The gate driving control signal GCS includes a gate start pulse GSP and a gate output enable signal GOE.

Additionally the timing controller 180 includes first through n-th look-up tables storing data mapping cell location information of the liquid crystal display panel 110 with different ECB brightness data.

In the narrow viewing angle mode, the timing controller 180 calculates a brightness data distribution of an image to be displayed at the liquid crystal display panel 110 using the supplied RGB data for a frame and selects one of the first to n-th look-up tables according to the calculated brightness data distribution. Next, the tuning controller 180 mixes the ECB brightness data from the selected look-up table with the RGB data and aligns the mixed RGB data and the ECB data in accordance with the cell structure of quad type and outputs the aligned data to the data driver 120.

In the wide viewing angle mode, the timing controller 180 controls the gate driver 130 to turn off the ECB sub pixels of the liquid crystal display panel 110 and aligns the received RGB data in accordance with the cell structure of quad type to output the aligned RGB data to the data driver 120.

An example of a configuration for and operation of a timing controller 180 for accomplishing the above described function will be described in detail with reference to FIG. 5.

Figure 5:
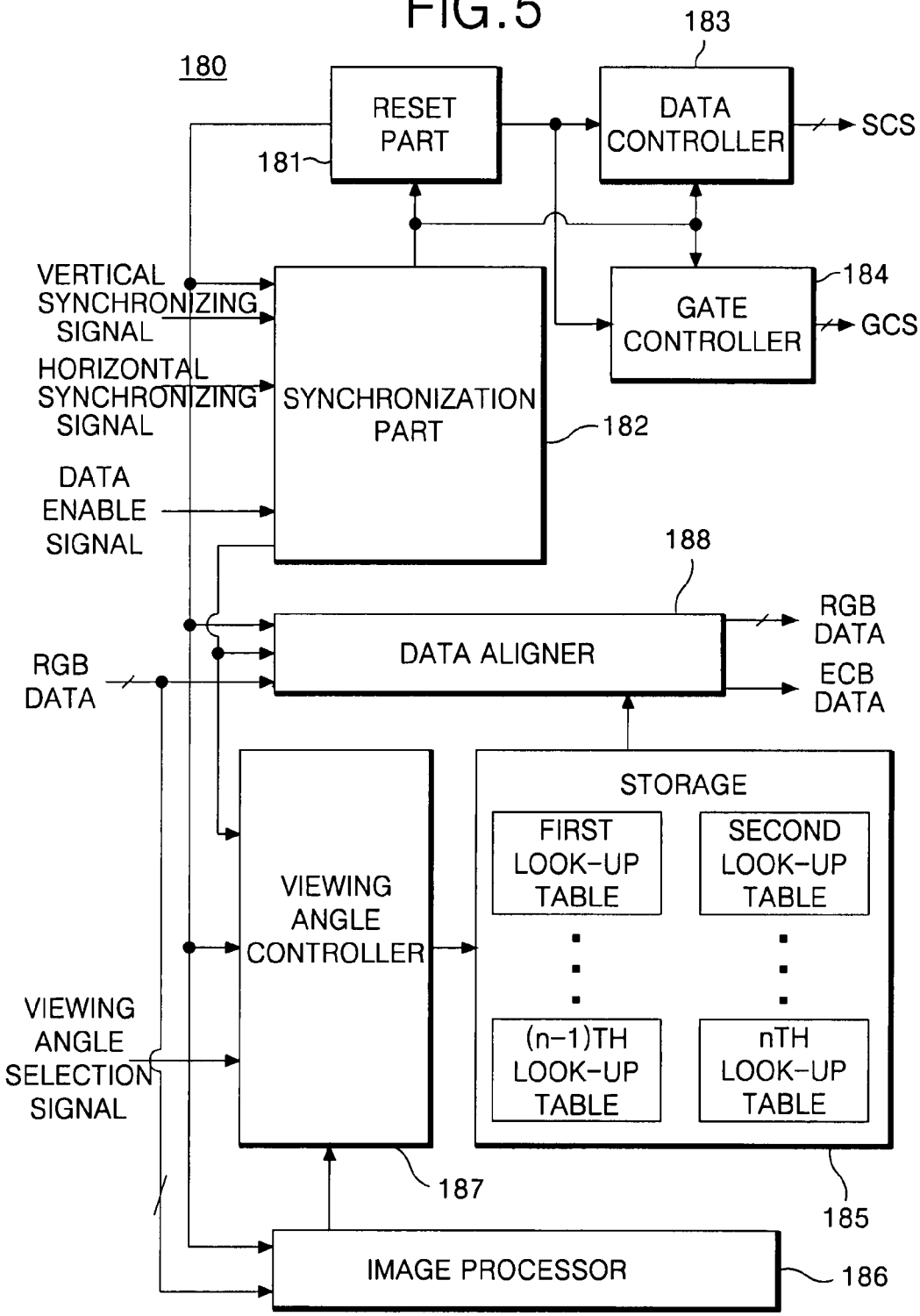
FIG. 5. is a diagram showing an embodiment of a timing controller of FIG. 4.

Referring to FIG. 5, the timing controller 180 includes a reset part 181, a synchronization part 182, a data controller 183, a gate controller 184, a memory or storage means 185, an image processor 186, a viewing angle controller 187, and a data aligner 188.

The reset part 181 initializes the synchronization part 182, the data controller 183, the gate controller 184, the image processor 186, the viewing angle controller 187, and the data aligner 188 when the liquid crystal display 100 is powered-on.

The synchronization part 182 is driven using the data enable signal DE to adjust a horizontal synchronization and a vertical synchronization of the RGB data and/or the ECB data supplied to the liquid crystal display panel 110 in accordance with the input vertical synchronizing signal Vsync and the input horizontal synchronizing signal Hsync. The synchronization part 182 synchronizes the reset part 181, the data controller 183, the gate controller 184, the viewing angle controller 187, and the data aligner 188 in accordance with the externally supplied vertical synchronizing signal Vsync and the supplied horizontal synchronizing signal Hsync.

The data controller 183 is initialized by the reset part 181 and is synchronized by the synchronization part 182 to generate the data driving control signal SCS to control the supply of the RGB data and/or the ECB data to the data driver 120. In other words, the data driver 120 supplies the RGB data and/or the ECB data generated by the data aligner 188 to the data lines DL1 to DL2*m* in response to the data driving control signal SCS.

The gate controller 184 is initialized by the reset part 181 and is synchronized by the synchronization part 182 to generate the gate driving control signal GCS for controlling the supply of the scanning pulse to the gate driver 130. In other words, the gate driver 130 supplies the scanning pulse to the gate lines connected to the sub pixels in response to the gate driving control signal GCS. The sub pixels are supplied with the RGB data and/or the ECB data via the plurality of gate lines GL1 to GL2*n*.

The memory or storage means 185 stores first through n-th look-up tables. Each of the n look-up tables stores a mapping of cell location information of the liquid crystal display panel 110 to ECB brightness data corresponding to a reference ECB brightness data. The location information of all cells included in the liquid crystal display panel 110 is set in each of the first to n-th look-up tables and the ECB brightness data mapped with above-mentioned cell location information is set differently in each of the first through n-th look-up tables. For example, cell location information and the ECB brightness data for a reference ECB brightness data of 100 nits are mapped and set in the first look-up table, cell location information and the ECB brightness data for a reference ECB brightness data of 90 nits are mapped and set in the second look-up table, cell location information and the ECB brightness data corresponding to a reference ECB brightness data of 50 nits are mapped and set in the (n−1)th look-up table, and cell location information and the ECB brightness data corresponding to a reference ECB brightness data of 25 nits are mapped and set in the n-th look-up table. One of the first to n-th look-up tables is selectively chosen using the viewing angle controller 187, and the selected look-up table outputs the ECB brightness data to the data aligner 188.

As described above, the ECB brightness data corresponding to different reference brightness levels is stored in each of the first to n-th look-up tables, so that an interference image having an adequate brightness level may be displayed at the ECB sub pixels in accordance with a brightness level of the background screen when the liquid crystal display device is in the narrow viewing angle mode.

The image processor 186 may implement a first calculating method that calculates a brightness data distribution of an entire image displayed at the liquid crystal display panel 110 or may alternatively implement a second calculating method that calculates a brightness data distribution of a specific area of an entire image displayed at the liquid crystal display panel 110.

In the first calculating method, when the RGB data to be supplied the liquid crystal display panel 110 for one frame are supplied to the image processor 186, the image processor 186 detects a brightness data of an entire image to be displayed and calculates a brightness data distribution of a whole image using the detected brightness data, supplies the calculated data brightness data distribution to the viewing angle controller 187.

In the second calculating method, when the RGB data to be supplied to the liquid crystal display panel 110 for one frame are supplied to the image processor 186, the image processor 186 samples the data for a specific area or portion of an image for the frame and detects a brightness data of the sampled portion of the image. The image processor 186 calculates a brightness data distribution to be displayed for the specific area of the image and outputs the calculated brightness data distribution to viewing angle controller 187.

The image processor 186 calculates a brightness level for the background screen displayed for one frame through the process of calculating the brightness data distribution. In other words, the brightness data distribution calculated by the image processor 186 represents a brightness level of the background screen to be displayed for one frame.

The viewing angle controller 187 selects the narrow viewing angle mode or the wide viewing angle mode in accordance with a received viewing angle selection signal.

If the viewing angle selection signal indicating the wide viewing angle mode is received, the viewing angle controller 187 does not select any of the first to n-th look-up tables of the memory or storage means 185 and accordingly does not supply stored ECB brightness data to the data aligner 188. In this case, since the data aligner 188 supplies RGB data to the data driver 120 and does not supply the ECB data to the data driver 120, and the ECB sub pixels provided at the liquid crystal display panel 110 are maintained off.

If the viewing angle selection signal indicating the narrow viewing angle mode is input to the viewing angle controller, the viewing angle controller 187 compares the brightness data distribution with the predetermined first to n-th reference brightness data. In the illustrated embodiment, the brightness data distribution is calculated by the image processor 186. The first to n-th reference brightness data has the brightness value corresponding to the ECB brightness data stored the first to n-th look-up tables. Accordingly, the viewing angle controller 187 selects a reference brightness data corresponding to the same value or the approximately the same value as the calculated brightness data distribution from among the predetermined first to n-th reference brightness data through a comparing process and selects the corresponding one of the first to n-th look-up tables. Data from the selected look-up table outputs ECB brightness data to the data aligner 188. The ECB brightness data represents brightness values for an interference image to be displayed at the ECB sub pixels for one frame.

For example, if a second reference brightness data of the predetermined first to n-th reference brightness data corresponds to the same value or the approximate value as the calculated brightness data, the viewing angle controller 187 selects the second look-up table holding ECB brightness data corresponding to the second reference brightness data from among the first to n-th look-up tables. Data from the selected second look-up table is supplied as ECB brightness data to the data aligner 188.

As described above, when the liquid crystal display panel is operated in the narrow viewing mode, the viewing angle controller 187 outputs the ECB brightness data corresponding to the brightness data distribution indicating the brightness level of the background screen for one frame. Accordingly, embodiments of the present invention prevent the interference image displayed at the EC sub pixels from interfering or to substantially interfering with viewing of an image by an observer towards the front of the screen when the observer sees the pixels at a front side in the narrow viewing angle mode. More specifically, if a white display image is displayed on a black background screen, a brightness level of the display is lowered. Thus, the display image is overlapped with the interference image when the observer sees the pixels at a front side of the liquid crystal display panel. In other words, if the display image having a high brightness is displayed to the background screen having a low brightness, a high brightness level of the display image is lowered or heightened in proportion to a low brightness level of the background screen. Thus, the display image is overlapped with the interference image when the observer sees the pixels at a front side of the liquid crystal display panel.

If RGB data are input to the data aligner 188 in the wide viewing angle mode, the data aligner 188 aligns the RGB data in accordance with the cell structure of quad type to output to the data driver 120. Alternatively, if the narrow mode is selected, the data aligner 188 mixes ECB brightness data and RGB data. As illustrated in FIG. 5, the ECB brightness data are retrieved from the memory 185 in the narrow viewing angle mode. Next, the data aligner 188 aligns the mixed RGB and ECB data in accordance with the cell structure of quad type to output them to the data driver 120.

A specific configuration and operation of the data aligner 188 having such a function will be described in detail with reference to FIG. 6. Herein, an operation of the data aligner 188 in the narrow viewing angle mode will be described.

Figure 6:
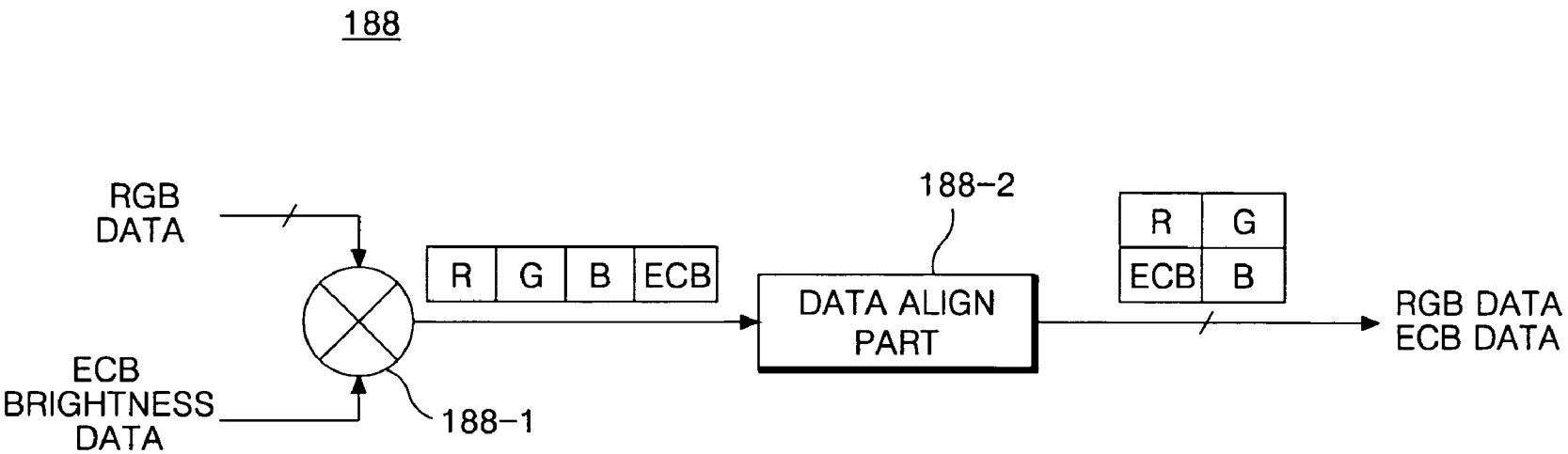
FIG. 6 is a diagram showing an embodiment of a data aligner of FIG. 5.

FIG. 6 is a diagram showing a data aligner in FIG. 5.

Referring to FIG. 6, the data aligner 188 includes a mixer 188-1 for mixing the input RGB data with the ECB brightness data retrieved from the memory 185 and a data aligner part 188-2 for aligning RGB data and ECB data in accordance with the cell structure of quad type.

The mixer 188-1 mixes RGB data with ECB brightness data. The RGB data are input in parallel from an external system. The ECB brightness data is retrieved from a look-up table selected from the first to n-th look-up tables by the viewing angle controller 187. The mixer 188-1 outputs the mixed RGB data and the ECB data for supply to the data aligner part 188-2.

The data aligner part 188-2 aligns RGB data and ECB data in accordance with the cell structure of the quad type cell and outputs the aligned data to the data driver 120. In the illustrated case, the RGB data and the ECB data are mixed in a stripe format by the mixer 188-1 prior to alignment by the data aligner part 188-2 for supply to a quad cell structure.

As described above, the present invention automatically adjusts brightness of the interference image displayed at the ECB sub pixels of cells formed in a quad type at the liquid crystal display panel in accordance with brightness of the background screen to eliminate or reduce an effect in which the interference image is perceived by an observer to be overlapped with the display image generated at the RGB sub pixels when the observer sees the pixels from a viewing position in front of the liquid crystal display panel. More specifically, if the display image having a high brightness is generated on a background screen having a low brightness, a display panel according to present invention allows the interference image to be overlapped on the display image when the observer sees the pixels at a front side of the liquid crystal display panel.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display, comprising:

a liquid crystal display panel having quad cells each including a R sub pixel, a G sub pixel, a B sub pixel, and an ECB sub pixel;

a storage means that stores first to n-th look-up tables each holding a mapping of one of first to n-th mappings of ECB brightness data to cell location information for the quad cells of the liquid crystal display panel;

an image processor that calculates a brightness data distribution of an image to be displayed using the liquid crystal display panel using input RGB data for one frame period;

a viewing angle controller that selects one of the first to the n-th look-up tables, the selected look-up table depending on the calculated brightness data distribution; and a data aligner that combines ECB brightness data received from a look-up table selected by the viewing angle controller with the input RGB data, and then aligns the combined RGB data and ECB brightness data for display in accordance with a quad cell structure.

2. The liquid crystal display as claimed in claim 1, wherein, the first to the n-th look-up tables are selectively selected by viewing angle controller to output ECB brightness data set to thereof to the data aligner.

3. The liquid crystal display as claimed in claim 1, wherein the image processor detects brightness data of an entire image to be displayed for one frame from the input RGB data and calculates a brightness data distribution of the entire image using the detected brightness data, and outputs the calculated brightness data distribution to the viewing angle controller.

4. The liquid crystal display as claimed in claim 1, wherein the image processor samples input RGB data for a specific area of an entire image to be displayed one frame to detect a brightness data of the sampled image and calculates a brightness data distribution of an image to be displayed at a specific area using the detected brightness data and outputs the brightness data distribution to the viewing angle controller.

5. The liquid crystal display as claimed 1, claim 1, wherein the viewing angle controller stores predetermined first to n-th reference brightness data having the same brightness value as the first to the n-th ECB brightness data.

6. The liquid crystal display as claimed in claim 5, wherein the viewing angle controller compares the calculated brightness data distribution with the predetermined first to n-th reference brightness data to detect a reference brightness data having the same value or the approximate value as the calculated brightness data distribution.

7. The liquid crystal display as claimed in claim 6, wherein the viewing angle controller selects a look-up table that the same ECB brightness data as the reference brightness data detected from the first to n-th look-up tables are set.

8. The liquid crystal display as claimed in claim 1, wherein the data aligner includes:

a mixer that mixing ECB brightness data output from a look-up table selected by the viewing angle controller using the input RGB data from the first to n-th look-up tables; and a data aligner that aligns RGB data and ECB brightness data mixed by the mixer in accordance with the cell structure of quad cell to output aligned RGB data and ECB brightness data.

9. A liquid crystal display, comprising:

a liquid crystal display panel having quad cells each including a R sub pixel, a G sub pixel, a B sub pixel, and an ECB sub pixel;

a timing controller that calculates a brightness data distribution of an image using input RGB data, and that selects any one of first to n-the ECB data, the selected ECB data chosen with reference to the calculated brightness data distribution, and that aligns and outputs the selected ECB data brightness and the input RGB data in accordance with a cell structure of a quad cell;

a data driver that converts digital RGB data and ECB data output from the timing controller into an analog data to supply the analog data to the liquid crystal display panel in response to a control signal from the timing controller; and a gate driver that selects and drives a quad cell using RGB data and ECB data output from the data driver in response to a control signal from the timing controller.

10. The liquid crystal display as claimed in claim 9, wherein the timing controller includes:

a storage means storing a first to a n-th look-up tables provided such that any one of first to n-th ECB brightness data and cell location information of the quid crystal display panel are correspondingly mapped;

an image processor that calculates a brightness data distribution of an image to be displayed at the liquid crystal display panel using the input RGB data for one frame period;

a viewing angle controller that selects any one of the first to the n-th look-up tables with reference calculated brightness data distribution; and a data aligner that mixes ECB brightness data retrieved from a look-up table selected by the viewing angle controller and the input RGB data, and then aligns the mixed RGB and ECB data for output in accordance with a cell structure of a quad cell.

11. The liquid crystal display as claimed in claim 10, wherein the first to the n-th look-up tables are selectively selected by the viewing angle controller to output ECB brightness data stored therein to the data aligner.

12. The liquid crystal display as claimed in claim 10, wherein the image processor detects a brightness data of a whole image to be displayed for one frame from the input RGB data calculates a brightness data distribution of a whole image using the detected bright less data to output it to the viewing angle controller.

13. The liquid crystal display as claimed in claim 10, wherein the image processor samples an image of a specific area of a whole image to be displayed by the input RGB input data for one frame to detect a brightness data of the sampled image and calculates a brightness data distribution of an image to be displayed at a specific area using the detected brightness data to output it to the viewing angle controller.

14. The liquid crystal display as claimed in claim 10, wherein the viewing angle controller stores a predetermined first to n-th reference brightness data having the same brightness value as the first to the n-th ECB brightness data.

15. The liquid crystal display as claimed in claim 14, wherein the viewing angle controller compares the calculated brightness data distribution with the predetermined first to n-th reference brightness data to detect a reference brightness data having the same value or the approximate value as the calculated brightness data distribution.

16. The liquid crystal display as claimed in claim 15, wherein the viewing angle controller selects a look-up table that the same ECB brightness data as tote reference brightness data detected from the first to n-th look-up tables are set.

17. The liquid crystal display as claimed in claim 10, wherein the data aligner includes a mixer that mixes ECB brightness data retrieved from a look-up table selected by the viewing angle controller using the input RGB data from the first to n-th look-up tables; and a data aligner part that aligns and outputs RGB data and ECB brightness data mixed by the mixer in accordance with the cell structure of a quad cell.

18. A method of driving a liquid crystal display, including a liquid crystal display panel having quad cells each including a R sub pixel, a G sub pixel, a B sub pixel, and an ECB sub pixel, the method comprising:

calculating a brightness data distribution of an image to be displayed at the liquid crystal display panel using input RGB data for one frame;

selecting any one of first to n-th ECB brightness data that are preset to correspond to a predetermined first to n-th look-up tables in accordance with the calculated brightness data distribution; and mixing the selected ECB brightness data and the input RGB data to align and output the mixed RGB data and the ECB data in accordance with the cell structure of a quad cell.

19. The method of driving the liquid crystal display as claimed in claim 18, wherein calculating a brightness data distribution of an image includes:

detecting a brightness data of a whole image to be displayed for one frame from the input RGB data; and calculating a brightness data distribution of an entire image using the detected brightness data.

20. The method of driving the liquid crystal display as claimed in claim 18, wherein calculating a brightness data distribution of an image includes:

sampling a specific area of an entire image to be displayed using input RGB for a frame;

detecting a brightness data of the sampled image; and calculating a brightness data distribution of the specific area of the entire image to be displayed using the detected brightness data.

21. The method of driving the liquid crystal display as claimed in claim 18, wherein selecting any one of first to n-th ECB brightness data includes:

comparing the calculated brightness data distribution with a predetermined first to n-th reference brightness data to detect a reference brightness data corresponding to one of the same value and the approximate value as the calculated brightness data distribution; and selecting an ECB brightness data of the first to n-th ECB brightness data having the same brightness value as the detected reference brightness data.

22. The method of driving the liquid crystal display as claimed in claim 18, wherein aligning and outputting the mixed RGB data and the ECB data includes:

mixing the input RGB data and the selected ECB brightness data; and aligning the mixed RGB data and the ECB brightness data in accordance with the cell structure of a quad cell of the liquid crystal display.

* * * * *